United States Patent [19]

Ahlf et al.

[11] Patent Number: 4,885,013

[45] Date of Patent: Dec. 5, 1989

[54] ARRANGEMENT OF FILTER BAGS IN ELECTRIC VACUUM CLEANERS

[75] Inventors: Heinz-Jürgen Ahlf, Bergisch/Gladbach; Gieland Gühne, Remscheid; Manfred Eckhart, Wuppertal, all of Fed. Rep. of Germany

[73] Assignee: Vorwerk & Co. Interholding GmbH, Wuppertal, Fed. Rep. of Germany

[21] Appl. No.: 187,559

[22] Filed: Apr. 28, 1988

[30] Foreign Application Priority Data

May 4, 1987 [DE] Fed. Rep. of Germany ..... 3714773

[51] Int. Cl.[4] ..... A47L 9/14

[52] U.S. Cl. ..... 55/367; 15/327 D; 15/352; 55/373; 55/374; 55/378; 55/381; 55/473

[58] Field of Search ..... 15/327 D, 327 E, 350, 15/352; 55/362, 367, 373–378, 381, 471–473

[56] References Cited

U.S. PATENT DOCUMENTS

| | | | |
|---|---|---|---|
| Re. 28,201 | 10/1974 | Hughes | 55/367 |
| 2,070,674 | 2/1937 | Muentener | 55/373 |
| 2,360,155 | 10/1944 | Nuffer et al. | 15/327 D |
| 2,833,372 | 5/1958 | Lappin et al. | 55/376 |
| 3,559,381 | 2/1971 | Fesco | 55/381 |
| 3,933,451 | 1/1976 | Johansson | 55/367 |
| 4,155,727 | 5/1979 | Kaulig | 55/381 |
| 4,452,618 | 6/1984 | Kuplas | 55/373 |
| 4,670,937 | 6/1987 | Sumerau et al. | 75/352 |
| 4,724,574 | 2/1988 | Bowerman et al. | 55/373 |

FOREIGN PATENT DOCUMENTS

| | | | |
|---|---|---|---|
| 208272 | 3/1956 | Australia | 55/376 |
| 2108377 | 5/1983 | United Kingdom | 15/350 |

*Primary Examiner*—Jay H. Woo
*Assistant Examiner*—C. Scott Bushey
*Attorney, Agent, or Firm*—Martin A. Farber

[57] ABSTRACT

The present invention relates to an arrangement of filter bags in electric vacuum cleaners in which the filter bag has a bottom plate which has an insertion opening for a fan-side air-blast socket and at least one side-edge indentation (28) and is arranged as a transverse wall in a filter-bag chamber (6) which is adjacent a motor-fan housing (5) and can be lifted off from it. A second side-edge indentation is disposed opposite first side-edge identation and housing-side profections extend into both indentations and protrude beyond the lower side of the bottom plate.

15 Claims, 6 Drawing Sheets

T
V
K
E
40
24
19
22
21
27
23
14
17
12'
20
39
32
33
18
12
31
6'
7
8
8'
26
5
1
30
29

ARRANGEMENT OF FILTER BAGS IN ELECTRIC VACUUM CLEANERS

FIELD AND BACKGROUND OF THE INVENTION

The present invention relates to an arrangement of filter bags in electric vacuum cleaners in which the filter bag has a bottom plate which has an insertion opening for the blower-side air-blast connection and at least one side indentation and is arranged as a transverse wall in a filter-bag chamber which to the motor-blower housing and can be lifted off from it.

The changing of the filter bag or, more precisely, the removal of the full filter bag, presupposes a certain amount of skill in many cases. Thus, for instance, upon the grasping of the filter bag itself there is a certain amount of skill in many cases. Thus, for instance, upon the grasping of the filter bag itself there is a certain amount of aspiration and thus a discharge of dust via the opening. In order to remedy this it is already known to interpose between the motor housing and a chamber of the vacuum cleaner, which receives the filter bag, a handle piece which is also insertable into said chamber and which is detachably connected to a bottom plate which forms the closure of the filter bag and has the opening. By pulling on the handle piece the filter bag is pulled out of the chamber. The handle piece is then disconnected and provided with a new filter bag.

SUMMARY OF THE INVENTION

The object of the invention is to provide an arrangement of filter bags in vacuum cleaners which guides the bottom plate to a direct actuating function and does this in structurally simple manner.

As a result of this development there is obtained an arrangement of this type of filter bags in vacuum cleaners having increased utilitarian value:

A special pull handle, i.e. a handle which can be attached to the bottom plate, can be dispensed with; rather, the removal of the full filter bag can now be effected by direct use of the bottom plates as such a handle. The structural means are simple and suitable so that opposite the edge indentation there is a second edge indentation and projections which protrude beyond the bottom side of the lower plate extending into both indentations. The position of corresponding indentations facing each other permits the bottom plate to be conveniently gripped by an ordinary clamping grip. In this connection the fingers extend into the one indentation and the opposing thumb into the other. After release of the removal region the two indentations are immediately apparent; to this extent they even suggest the function assigned to them. To this extent no instructions are required either. The projections which extend into the indentations keep the indentations closed during operation of the vacuum cleaner. The supplement the bottomplate sections have been lost by the indentations which forming the grip openings. Since they even protrude to beyond the lower side of the bottom plate bulges cannot arise which subject the wall of the filter bag to increased stress or a sort of crease constellation in which these wall zones will be subject to increased mechanical stress. Furthermore, the projections also indicate whether the filter bag or its bottom plate is correctly inserted. Furthermore, one advantageous measure is that the wall of the filter bag extends across to the indentations and is bent out by the projections from the lower side of the bottom plate. The supply of wall obtained by the correspondingly intersecting course is pushed out by the projections in the opposite direction, which practically takes place entirely free of stress. Furthermore, in this way an optimum bag cross section can be taken as a basis. The corner fold of the edge does not have to be placed behind the base of the indentation. Furthermore, it is preferable for the glue line of the filter-bag wall to have recesses which are directed towards the center and which extend with the same contour as the edge of the indentations. The corresponding offset leads at the same time to an adhesive arrangement which is improved as a whole since the glue line is made longer by the corresponding detour. In order to retain a homogeneous wall structure specifically in the region of the recesses, the double layer of the filter-bag wall which forms the filter-bag longitudinal gluing which lies offset with respect to the indentations is glued in simple manner to the bottom plate. The recesses advisedly assume a trapezoidal course. In the interest of, in particular, also an ergonometric contour, the base is aligned in this connection with the direction of continuation of the edge of the bottom plate.

In order to obtain a more sensitive entrance of the projections into the indentations, the projection end surfaces are rounded in ball shape on their side facing the filter-bag wall. This results in a sort of corrective action with respect to the bottom plate. In order to have indentations which are as large as possible as grip openings, the bottom plate of the filter bag is fixed merely by the resting of the edge thereof, which corresponds in the resting region of the contour of the filter-bag chamber, on an inner step of the filter-bag chamber. For a clean, convenient removal of the filter bag it is advantageous for the filter bag to be in a socket-connection communication with respect to a filter-bag intermediate support which is carried along upon the swinging open of the chamber and which bears the valve closure member and from which the filter bag can be separated, for instance on the other side of the vertical position of the socket -connection cross-sectional plane. Dust emergence or the falling out of larger, heavier articles, is practically preventded simply due to the above-explained change in position of the filter bag. In this connection changing the filter bag can even be effected in its normal position of use for the electric vacuum cleaner designed as a hand-held appliance; it need not be laid on its side. Furthermore, in the case of vacuum-cleaner types of this kind the well-proven energy-favorable arrangement can be retained, namely that the motor operates from the bottom of the top and the filter bag is accordingly charged with the dust-laden air from the bottom. The swing opening, which takes place in the plane of the joint between motor housing and filter-bag chamber brings about not only optimal accessibility for the operation described but also favorable prerequisites for the assembling of the appliance as a whole. The carried-along filter-bag intermediate support acts like an accompanying cover of the socket connection. As soon as the intermediate support reaches said position, the filter bag can be detached. Since the mouth of the filter bagis exposed only in this position, the contents are reliably held back to prevent fall out. It is furthermore particularly advantageous for the valve-closure member to even sit on the intermediate support. The filter bags therefore does not have to be equipped any longer in this respect if such a development is desired. The handling is optimized by an automatic separation of the socket-connection communication by stopping the swinging movement of the intermediate support and the further swinging of a chamber socket. If this movement of the chamber socket encompasses a fully useful angle of 180° then the filter bag can very simply be pulled out, like an insert, from the then vertically standing filter-bag chamber which is open on top. The axis of swing of the chamber socket is arranged approximately at the height of the resting surface of the bottom of the filter bag. In this case, intermediate support and chanber socket swing advisedly around a common axis of swing. The stopping of the intermediate support is the said approximately vertical filter-bag release position is advisedly effected by a swing limiting stop which lies adjacent the common axis of swing. The swinging open is in this case facilitated by a handle on the free end side of the intermediate support. The closed position, on the other hand, is secured in customary manner, for instance by a detent-hook lock which can be actuated by push button. For a structurally simple, spatially small valve-closure device the invention proposes that the valve closure member be formed of a valve flap on the upper end edge of a socket of the intermediate support which extends into the bottom plate of the filter bag, the bottom plate of the filter bag having a foam lining from which a valve flap of smaller diameter than that of the socket is cut out. The said socket leads to a sealing closure even in the case of tolerance-caused deviations of the participating parts. In addition to projections another indicator is provided which indicates whether the filter bag is in its functionally proper position or whether a filter bag which is proper for the operation has been used, in the manner that orientation features are arranged on the periphery of the filter-bag bottom plate, they being associated with mating features in the region of the inner wall of the chamber socket.

DETAILED DESCRIPTION OF THE PREFERRED EMBODIMENTS

Figure 1:
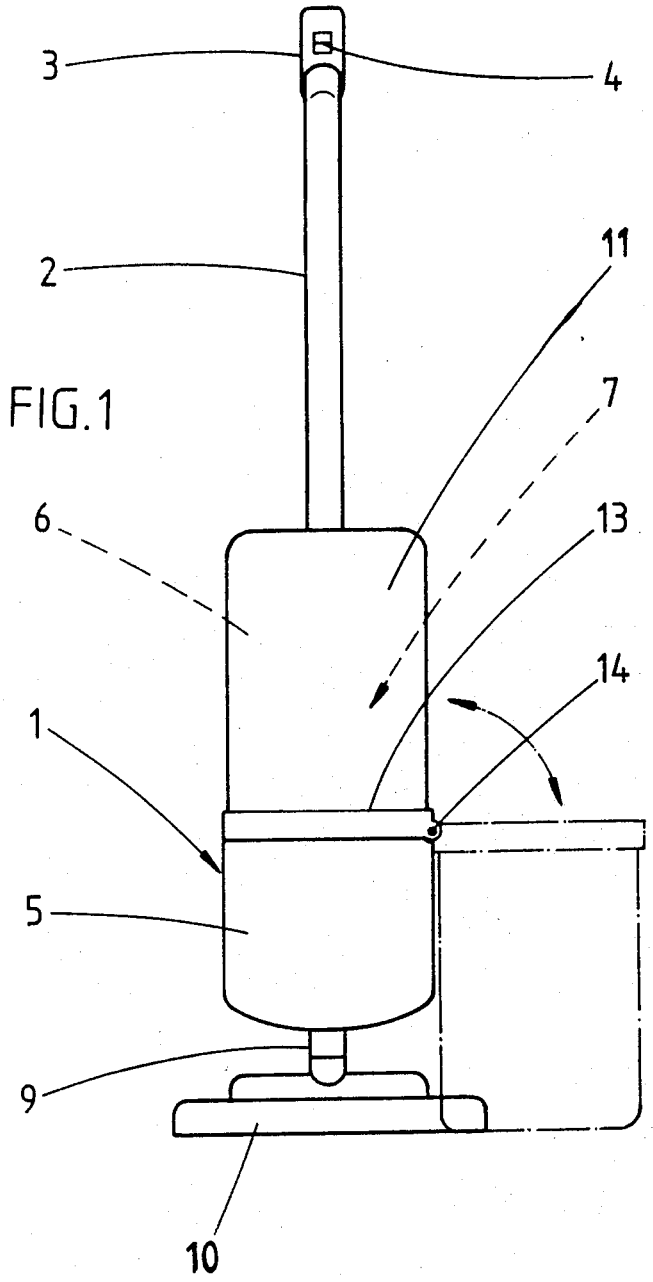
FIG. 1 is a view of an electric vacuum cleaner taking into account the arrangement of filter bags in accordance with the invention.

The electric vacuum cleaner which is adapted to the arrangement of filter bags in accordance with the invention is designed as a hand-held appliance. It has a housing 1, adjoining which in upward direction there is a rod 2 with handle 3 at one end.

In the transition region between the handle 3 and the rod 2 there is an on/off switch 4. The electric cord connection has not been shown.

The housing 1 of the vacuum cleaner is divided into a motor housing 5 and a chamber 6, extending above it, to receive a filter bag 7. The motor fan has not been shown in the drawing.

The side of the filter bag 7 which faces the motor housing 5 is in socket-connection communication with a fan-air channel 8.

The motor housing 5 passes at the bottom into a tube coupling 9 (see FIG. 1) which produces the air-flow connection to a suction nozzle 10. The suction nozzle 10 can be a so-called suction-brush nozzle which contains, within the nozzle mouth, a brush roller which is placed in rotation by a separate drive.

The motor fan therefore operates from the bottom to the top and accordingly presses the dust-laden air into the filter bag 7 which is arranged upside down above the motor housing 5.

The cross section of the housing 1 is long and rectangular with slightly arched wide sides and slightly arched narrow sides. In FIG. 1 the vacuum cleaner is seen on one of the wide sides.

The chamber 6 which receives the filter bag 7 which is of a corresponding cross section, is formed of a textile bag 11 stiffened with a wire or plastic basket and which passes at the bottom, i.e. on the motor-housing side, into a stiffened rim in the form of a chamber socket 12. The basket-stiffened textile bag 11 can be associated with this chamber socket 12 by means of a detachable clip-plug connection. The region of attachment is stepped-down for this purpose. The step can be noted in FIG. 1. It is designated 13 and permits a well-defined inner-outer association of the textile bag 11. An inner plug attachment is preferred.

For the removal of the filter bag 7, the housing 1 can be swung open with practically complete freeing of its cross section. The swung-open position can be noted from FIG. 1 (shown in dot-dash line) and FIGS. 5 and 7. The axis of swing 14 which makes this swinging open possible is located on the one narrow side of the housing 1. Its chamber-socket-side bearing lugs are designated 15. These bearing lugs 15 lie in the transition region between the narrow side and the wide side of the chamber 6. A continuous bearing lug of the motor housing 5 extends between the two bearing lugs 15.

In the region of the joint between the motor housing 5 and the chamber 6 there is furthermore integrated an intermediate support T on which the filter bag 7 sits.

The filter-bag intermediate support T has a contour adapted to the cross section of the housing but is set back from the outer wall of the housing 1 so that it is substantially completely invisible in the coaxial position of motor housing 5 and chamber 6 shown in FIG. 1. Except for a small place of access it is surrounded, namely, by the extended lower rim of the chamber socket 12 of the filter-bag intermediate support T which is also arranged swingably and swings around the same axis of swing 14 as the filter-bag chamber 6. On the hinge side the intermediate support T therefore, in the same way as the chamber socket 12, also forms two bearing lugs, designated 16.

Figure 3:
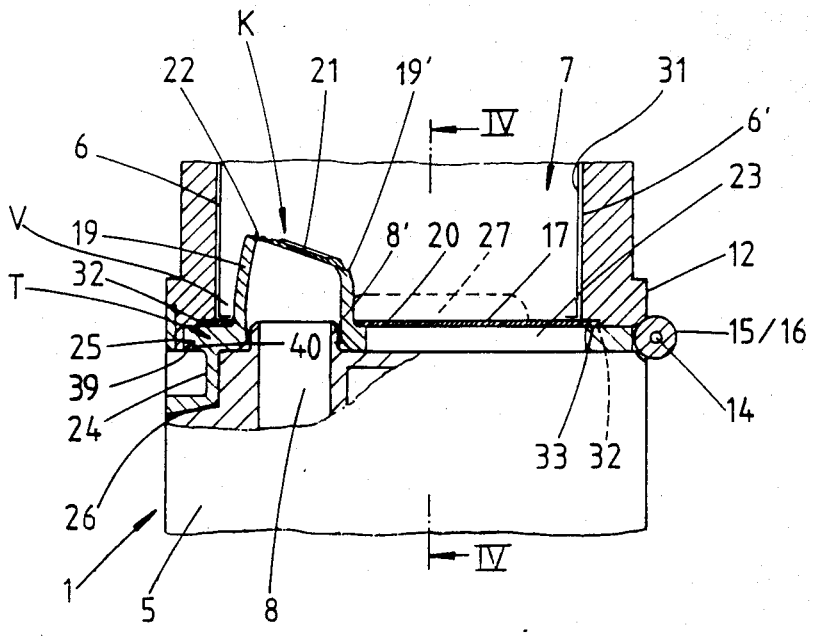
FIG. 3 shows the region of the place of swing of the vacuum cleaner in the closed position, in a fragmentary view.

The filter bag 7 which directly adjoins the intermediate support T has a bottom plate 17. Its general contour corresponds also to the cross-sectional shape of the chamber socket 12 which, for the supporting application in the region of the narrow sides of the filter-bag bottom plate 17 on the inner wall forms respective rim steps 18. In this way the bottom plate 17 cannot slide into the chamber 6 in the swung-open position of the apparatus. The bridge-shaped resting of the bottom plate 17, on the other hand, however, produces a certain bendability of the bottom plate 17 in the central region. The common axis of swing 14 of chamber socket 12 and filter-bag intermediate support T extends approximately at the height of the resting rim step 18 of the filter-bag bottom plate 17. In the closed housing 1 (FIG. 3) the rim step 18 extends over the top of the said bottom plate 17 so that, upon the suction blowing, it is not pushed off in upward direction. The top side of the bottom plate 17, as already indicated, rests on the top side of the filter-bag intermediate support T. In this connection there is obtained a sort of clamping-jaw mounting between chamber socket 12 and intermediate support T in the regions of the narrow side of the bottom plate 17.

In this position the fan-air channel 8 with its offset cylindrical mouthpiece end 8' extends into the lower region of a socket 19. The latter protrudes beyond the top of the valve-bag intermediate support T. The socket 19 is developed directly on the intermediate support T and extends, passing through an opening 20 of corresponding cross section in the filter-bag bottom plate 17, into the inside of the filter bag 7, closing off the edge.

In order, with the upside-down position of the filter bag shown, to avoid having vacuumed material drop back into the region of the motor housing 5, the socket 12 forms a valve flap 21 at its free end. The valve flap rests with the predominant region of the edge freely on the end edge of the socket 19. It is fixed merely in the position designated 22 so that it lifts off under the action of the flow of air but returns into its closed position upon the reduction in the corresponding bottom-side load. The valve flap 21 can be developed as separate structural part and can be-associated with the place 22 by means of a clip attachment; alternatively, there is of course the possibility of molding thereon in case of corresponding flexible material of the socket 19 or filter-bag intermediate support T.

The socket 19 tapers down towards its free end so that its introduction into the opening 20 has practically a centering effect.

Figure 2:
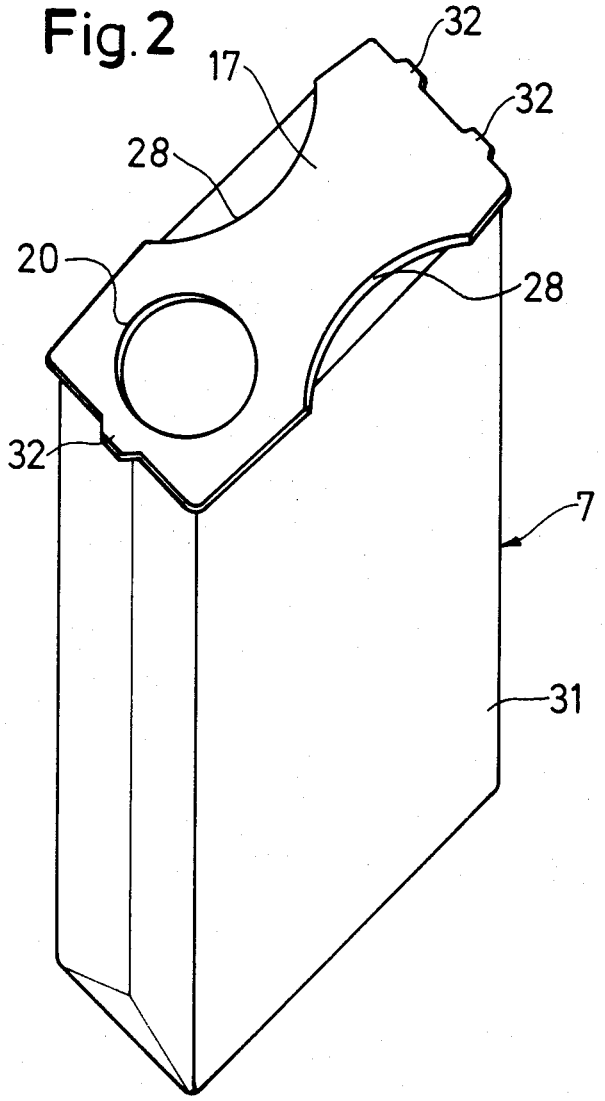
FIG. 2 is a perspective view of the filter bag.

As can be noted from FIG. 2, the end edge 19' of the socket 19 is beveled. It extends downward in the direction of the hinge axis 19. An imaginary line in this direction intersects the hinge axis. The connecting place 22 lies in the upper region of the socket end edge 19'.

The socket 19 advisedly otherwise assumes a radial course of curvatue to the axis 14. Between the root region of the socket 19 and the region on the axis of swing side the intermediate support T has a window-like opening. This opening bears the reference number 23. The hinge-side frame leg has in this connection a greater width than the two frame legs facing the wide side wall of the housing.

Figure 4:
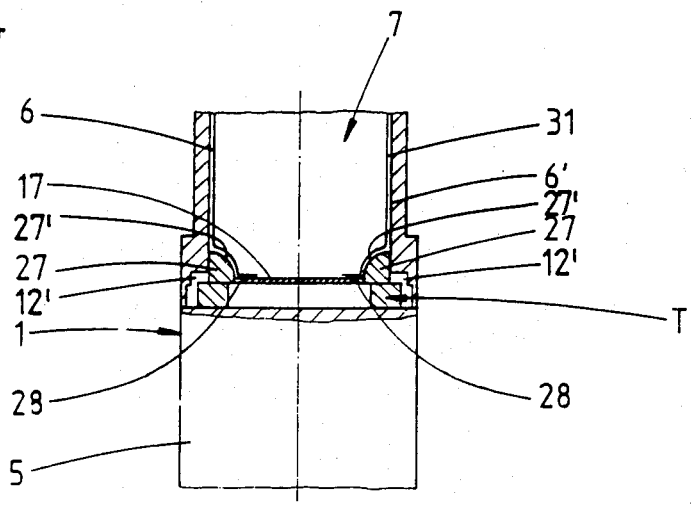
FIG. 4 is a section along the line IV—IV of FIG. 3.

On the free end, the intermediate support T forms a freely accessible handle 24 at its end side there. There is concerned here a bottom angular extension of the intermediate support T. The angular extension originates from a region which is set back with respect to the end side 25 there. The corresponding leg extends vertically. The substantially horizontal leg adjoining the same extends back to the outer wall of the housing 1 and terminates flush with the latter. In the region of the handle 24 a hook-detent device is seated (not shown in detail) which is actuatable by push button and which secures the closed position of the housing. The corresponding region of the motor housing 5 is cut out in niche-like fashion in order to receive the handle 24. The recess bears the reference number 26. Upward-directed projections 27 also extend in the region of the longer frame legs thereof from the top side of the intermediate support T. The longer frame legs and in the operating condition of the electrc vacuum cleaner, they close two indentations 29 forming grip openings on the longer rim edges of the filterbag bottom plate 17. The corresponding inserted position can be clearly noted from FIG. 4.

Figure 8:
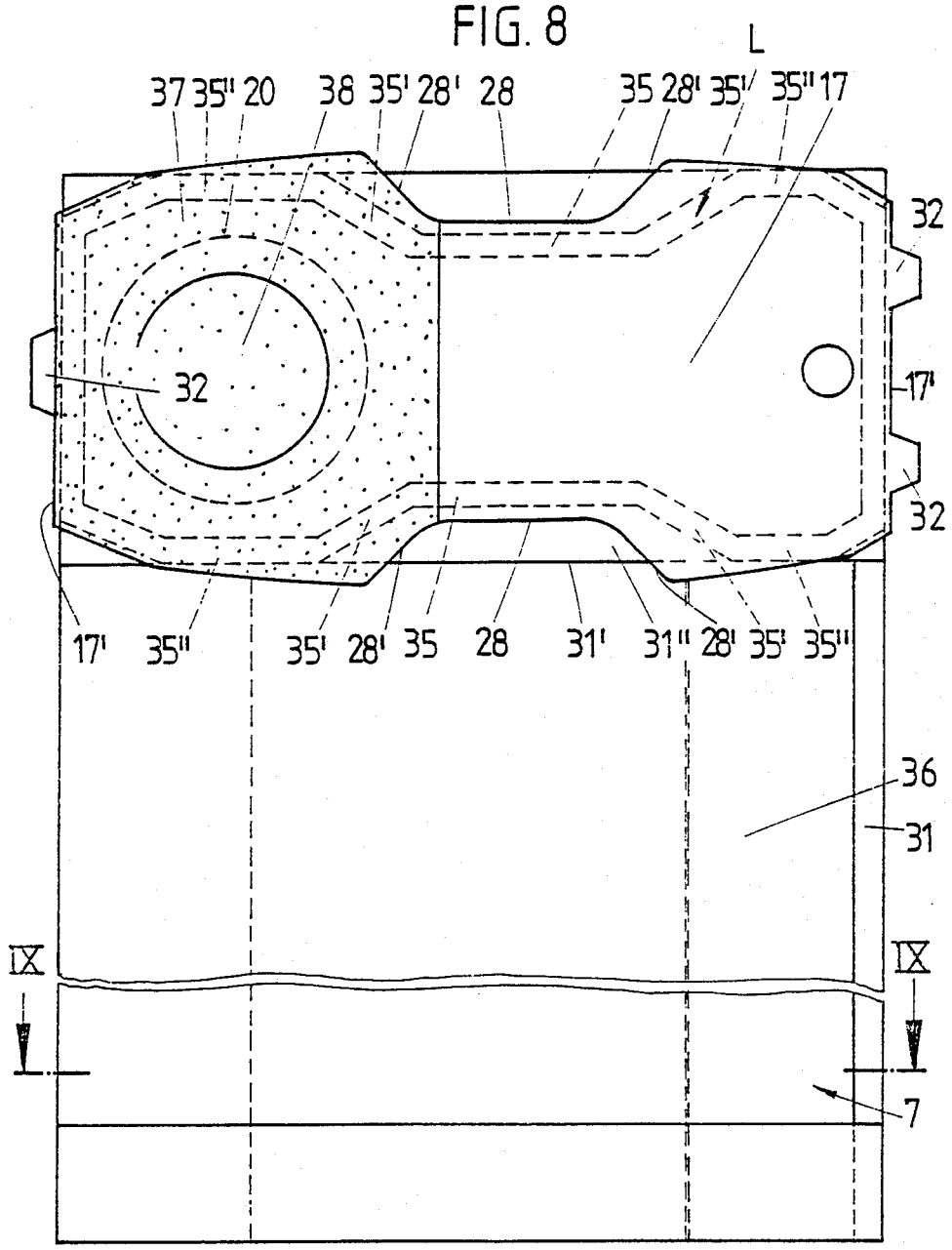
FIG. 8 is a top view of the folded filter bag showing the course of the glue line or glue track between filter-bag wall and bottom plate.

The indentations 28 can be developed in the form of uniform roundings (see FIG. 2) or else assume a trapezoidal course, as can be noted from FIG. 8. The base of the trapezoid is aligned with the lateral edge of the bottom plate 17. The projections protrude beyond the lower side of the bottom plate 17. This lower side is the side of the bottom plate facing the inside of the filter bag. In this connection therefore not only is the cross-sectional space of the indentations filled up but the filter-bag wall 31 is also supported against undesired bulging. Thus it cannot be torn or damaged. The same holding-back results also upon reaching into the indentations 28 which form the grip openings and are open towards the corresponding inner wall of the chamber socket 12. In the open position of the housing the wasp-waisted central region of the bottom plate 17 of the filter bag can be conveniently grasped by a suitable clamping grasp and pulled out of the chamber 6. The association of the wall 31 of the filter bag with the lower side of the bottom plate 17 is effected cross-wise to both indentations 28. Reference is had to FIG. 8. The folded corner 31' of the tucked-in end section 31' of the filter-bag wall 31 on the bottom-plate side extends approximately to half the depth of indentation, namely parallel to the trapezoid cover or as circular section line or "chord" to the rounded indentation 28.

The end section 31'' of the filter bag wall 31, which section is folded in on all sides, is fastened via an glue line or glue track L which extends approximatley with the same contour as the edge of the indentations 28 and has recesses 35 directed toward the middle. To be sure, the flanks 35' formed by these recesses 35 are not in as steep an angle of about 45° as the corresponding flank 28' of the indentation 29. The corresponding course of the indentation results in an additional fastening zone for the glue line or track L. The flanks 35' then pass into an extension line 35'' which extends parallel in space to the base of the recess in order then to follow the bends or the course of the narrow lateral edges 17' of the bottom plate 17.

Figure 9:
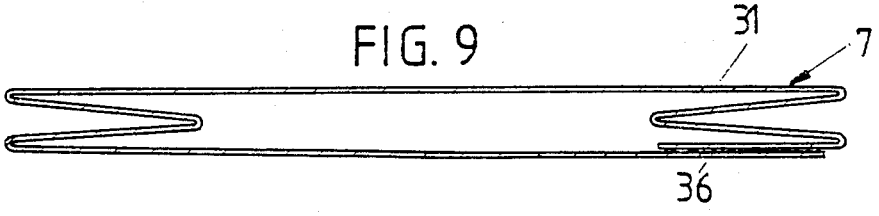
FIG. 9 is a section along the line IX—IX of FIG. 9.

The filter bag 7 is formed by a long web-like blank folded into a tube. The double layer 36 forming the filter-bag longitudinal gluing in this connection can be noted from FIGS. 8 and 9. The overlap region of the double layer 36 of the filter-bag wall 31 is about 2 cm. The double layer 36 is staggered laterally to the indentations 28 and is therefore glued to the bottom plate 17 in a wider end section, here the right end section, of the bottom plate.

The end of the filter bag 7 lying opposite the bottom plate 17 is closed by tucking and gluing.

The other, wider and therefore left-hand end section contains the opening 20 for the socket 19. The filter bag according to FIG. 8 is, with respect to this opening 20, still further developed to the effect that the bottom plate 17 is provided on the top and therefore on the side facing away from the inside of the bag, with a foam backing 37. There is concerned a thin foam layer of closed-pore soft foam. A valve flap is cut out from this foam-backing layer, concentrically to the opening 20 of larger cross section here. The diameter thereof is less than that of the socket-side valve flap 21.

Furthermore, the filter-bag intermediate support T is so associated and developed that it has a limited angle of swing, i.e. it cannot come into the 180° angular position of the chamber socket 12; rather, it remains in a position which lies approximately in or on the other side of the vertical position E—E of the socket-connection cross-sectional plane so that the socket-connection communication V lies on the other side of the angular bisector of the maximum angle of swing of 180°. In this position there is sufficient free space for the filter bag 7 to be withdrawn from the intermediate support T (see FIG. 5). The corresponding position is defined by a limiting stop 29 between the bearing lug of the motor housing 5 and the rear flank 30 lying in th da direction of swing of one or both bearing lugs 16 of the filter bag 16 of the filter-bag intermediate support T (see FIG. 6).

Figures 5, 6:
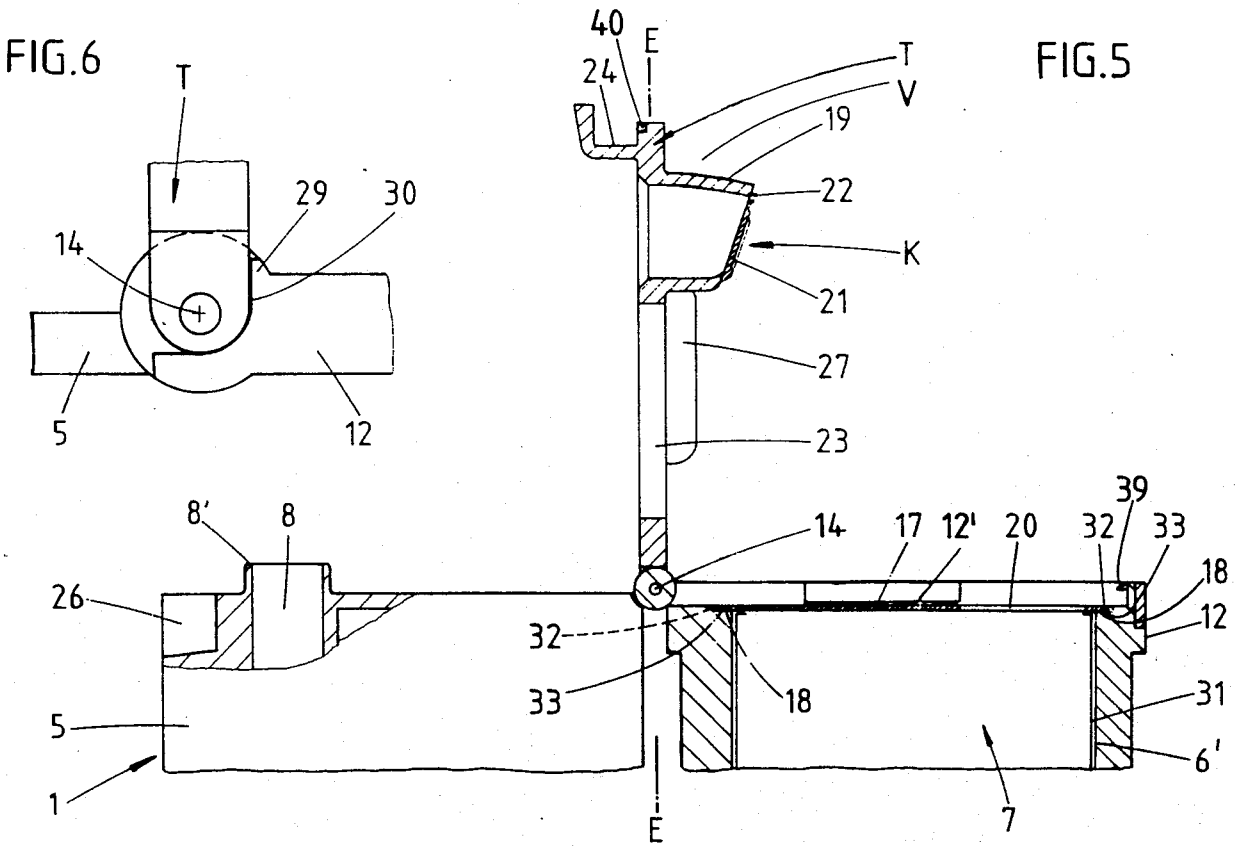
FIG. 5 is a showing corresponding to FIG. 3 but in the swung-open condition and approximately in the position of the intermediate support stopped in the vertical plane.
FIG. 6 shows the swing-limiting stop which produces this stopping, in an individual enlarged view.

In addition to this type of separation of intermediate support T and filter bag 7, there is also present that of an automatic separation of the socket-connection communication V, namely by the aforementioned stopping of the swinging motion of the intermediate support T and a further swinging of the chamber socket 12 or the chamber 6 into the 180° position shown in FIG. 5. The static friction of the filterbag wall 31 on the chamber wall 6' in combination with a certain pressure of filling namely holds the filter bag 7 frictionally fast in the said chamber. The transition into the position reversed to the upside-down position and therefore with opening 20 pointing upwards taken place without the possibility of an escape of dust or larger particles. The filter bag 7 can therefore be conveniently gripped in the manner explained above and lifted out. The filter-bag wall 31 is not pushed in. It is not necessary to touch the wall upon the removal; all aspiration is absent. A suction effect is obtained by stretching the bag. The insertion of a new filter bag 7 is readily possible in the same way since the entire cross section of the chamber 6 is open towards the top (see FIG. 1). Accordingly, it is merely necessary still to swing the chamber back into the position shown in sold line in FIG. 1, into position so that the upper structure of the housing 1 which comprises the chamber 6 automatically engages on the motor housing 5. In the return swing path, the opening 20 captures the socket 19 or vice versa. This can take place in the vertical position of the filter-bag intermediat support T, which is possibly still present with frictional lock, or else, however, only when the back of the intermediate support T again rests on the top of the motor housing 5. In the closed position, the projections 27 substantially fill up th indentations 28 forming the grip openings, i.e. to such an extent that upon inflating the filter bag or else by the filling load no bulging out of the fleece-like paper filter wall 31 can take place.

In order to enlarge the indentations 28 opposite each other, the wall region of the inner wall of the chamber socket 12, which region lies in this direction and therefore points outward, is further somewhat cutout. The recesses bear the reference number 12'.

For foolproof association of the filter bag 7 in the proper position, its bottom plate 17 is provided in the region of both narrow sides with orientation features 32 which engage in suitable mating features 33 in the region of the inner wall of the chamber socket 12. The orientation features are tapezoidal projections on the narrow side of the flat body which forms the bottom 17 and may consist of cardboard or plastic. In this way a correctly aligned position is obtained betwen opening 20 and socket 19 before an improper association is noticed due to the housing parts coming together in an improper closing position.

Figure 7:
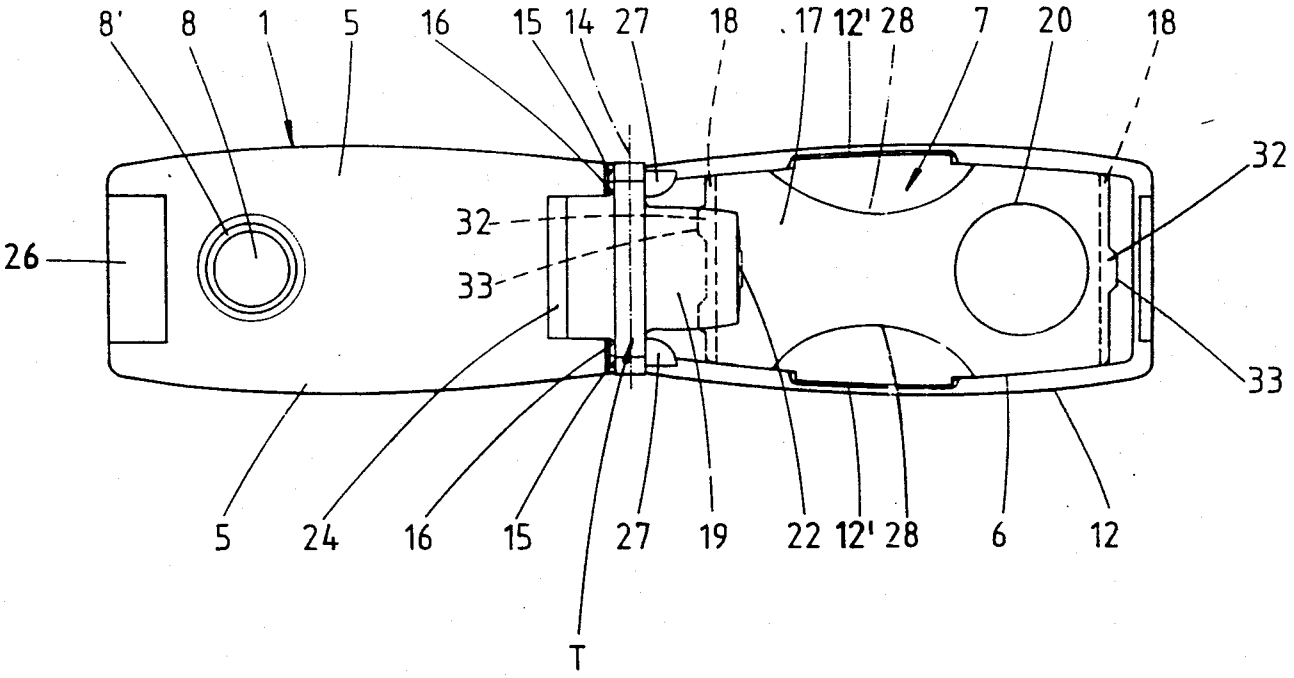
FIG. 7 is a top view of FIG. 5.

The facing lengthwise sides of the porjections 27 are transversely rounded, as can be noted from FIG. 7, which also serves for the associating in proper position of the bottom plate 17. they act as control surfaces on the corresponding rounded or trapezoidal niche base of the indentations 28.

Instead of the stop means shown in FIG. 6, a separation of the intermediate support T from the chamber 6 of the filter bag 7 can be effected so that both parts are arranged eccentrically to each other with respect to the axis of swing 14. The eccentricity is about 1.5 mm. In this connection the narrow side of the inner wall of the chamber socket 12 which faces away from the axis of swing 14 has a hook-like detent projection 39 pointing in the direction to the axis 14 and which cooperates with a detent shoulder 40 on the corresponding face end of the filter-bag intermediate support T. With due consideration of the eccentric supporting of the axis, the intermediate support T which acts like a drag cover extending for instance, in the vertical position form the region of the detent projection 39.

What is claimed is:

1. A vacuum cleaner system comprising:

a removable filter bag having an enclosing wall and a bottom plate secured to said wall;

a chamber containing said bag, said chamber having an entrance for removably inserting said bag into the chamber;

a motor-fan housing for directing air flow through said chamber; and support means located at said chamber entrance for engagement with said bottom plate of said bag to support said bag, said support means having conduit means for guiding air into said bag, the bottom plate of said bag having an opening for engagement with said conduit means; and wherein said bottom plate has a first side-edge indentation and a second side-edge indentation disposed opposite said first side-edge indentation; and said support means has projections extending into both said indentations and protruding beyond a side of said bottom plate to contact said wall.

2. A system according to claim 1, wherein said filter-bag wall extends to cross both indentations, said wall being bent out from said side of said bottom plate by the projections.

3. A system according to claim 1, further comprising a glue line between said wall and said plate, said glue line being directed transversely of an edge of said plate towards the center of the plate and extending with approximately the same contour as an edge of each said indentations.

4. A system according to claim 1, wherein said filter-bag wall has a double layer forming a filter-bag longitudinal glue line, said glue line being glued and lying offset on said plate laterally to said indentations.

5. A system according to claim 1, wherein said indentations extend approximately trapezoidally.

6. A system according to claim 1, wherein said projections have end surfaces formed with barrel-shaped rounding on the side thereof facing the filter-bag wall.

7. A system according to claim 1, wherein the entrance of said chamber has an inner step; and said bottom plate of said filter bag is fixed merely by resting its edge on said inner step of the filter-bag chamber, there being a resting region defined by a contour of the filter chamber.

8. A system according to claim 1, wherein said support means is a filter-bag intermediate support which is carried along upon a swinging open of the chamber, said support means having a valve-closure element from which the filter bag can be separated beyond a cross-sectional plane socket connection, said filter bag being in socket-connection communication with said filter-bag intermediate support.

9. A system according to claim 8, wherein said chamber has a socket; and there is an automatic separation of the socket-connection by a stopping of the swinging motion of the intermediate support and by further a swinging of said chamber socket.

10. A system according to claim 9, wherein the swing of the chamber socket has an axis which is located approximately at the filter-bag bottom plate.

11. A system according to claim 8, wherein the intermediate support and the chamber socket swing around a common axis of swing.

12. A system according to claim 11, further comprising a swing-limiting stop for the intermediate support, adjacent the common axis of swing.

13. A system according to claim 8, wherein said intermediate support has a free end and a handle located on a free end side of the intermediate support.

14. A system according to claim 8, wherein said intermediate support has a socket; and said valve-closure member is formed by a valve flap on the upper end edge of the socket of the intermediate support, said intermediate support socket engaging the bottom plate of the filter bag, and the bottom plate having a foam backing from which there is cut free a valve flap of smaller diameter than the diameter of the opening.

15. A system according to claim 9, further comprising orientation features on a periphery of the filter-bag bottom plate, said features having associated mating features within a region of the inner wall of the chamber socket.

* * * * *